US009937526B2

(12) United States Patent
Shiu et al.

(10) Patent No.: US 9,937,526 B2
(45) Date of Patent: Apr. 10, 2018

(54) ANTENNA STRUCTURES WITH MOLDED AND COATED SUBSTRATES

(75) Inventors: Boon W. Shiu, San Jose, CA (US); Peter Bevelacqua, Cupertino, CA (US); Jiang Zhu, Sunnyvale, CA (US); Jerzy Guterman, Mountain View, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 784 days.

(21) Appl. No.: 13/250,784

(22) Filed: Sep. 30, 2011

(65) Prior Publication Data

US 2013/0082895 A1 Apr. 4, 2013

(51) Int. Cl.

| | |
|---|---|
| ***B05D 5/12*** | (2006.01) |
| ***C25D 5/02*** | (2006.01) |
| ***H01Q 1/38*** | (2006.01) |
| ***H01Q 7/00*** | (2006.01) |
| ***C25D 7/00*** | (2006.01) |
| ***H01Q 1/24*** | (2006.01) |

(52) U.S. Cl.

CPC ..... *B05D 5/12* (2013.01); *C25D 5/02* (2013.01); *C25D 7/00* (2013.01); *H01Q 1/243* (2013.01); *H01Q 1/38* (2013.01); *H01Q 7/00* (2013.01)

(58) Field of Classification Search

USPC ..... 205/118; 343/866

See application file for complete search history.

(56) References Cited

U.S. PATENT DOCUMENTS

| | | | | |
|---|---|---|---|---|
| 5,495,262 | A * | 2/1996 | Klebe | 343/853 |
| 5,786,792 | A * | 7/1998 | Bellus et al. | 343/770 |
| 6,333,722 | B1 * | 12/2001 | Kitano | 343/895 |
| 6,867,746 | B2 | 3/2005 | Mendolia et al. | |
| 6,930,256 | B1 * | 8/2005 | Huemoeller et al. | 174/260 |
| 7,168,152 | B1 * | 1/2007 | Ehret et al. | 29/600 |
| 7,500,610 | B1 * | 3/2009 | Hadley et al. | 235/451 |
| 2003/0103008 | A1 * | 6/2003 | Petropoulos et al. | 343/702 |
| 2007/0182640 | A1 * | 8/2007 | Oohira | 343/700 MS |

(Continued)

OTHER PUBLICATIONS

Nationwide Plastics Inc., MSDS ULTEM 2300, GE Plastics, Jan. 2007, www.nationwideplastics.net.*

(Continued)

*Primary Examiner* — Stefanie S Wittenberg

(74) *Attorney, Agent, or Firm* — Treyz Law Group, P.C.; G. Victor Treyz; Michael H. Lyons

(57) ABSTRACT

Electronic devices may be provided with antenna structures. The antenna structures may be used in wirelessly transmitting and receiving radio-frequency signals. Antenna structures may be formed from molded dielectric substrates. Patterned conductive material may be formed on the dielectric substrates. The dielectric substrates may be formed from molded materials such as glass or ceramic. Sheets of dielectric or dielectric powder may be compressed to form a dielectric substrate of a desired shape. The patterned conductive material may be formed from metallic paint or other conductors. A hollow antenna chamber may be formed by joining molded dielectric structures. An antenna such as an indirectly-fed loop antenna or other antennas may be formed from the molded dielectric substrates and patterned conductors.

3 Claims, 12 Drawing Sheets

(56) References Cited

U.S. PATENT DOCUMENTS

| | | | | |
|---|---|---|---|---|
| 2009/0051616 | A1* | 2/2009 | Hong et al. | 343/872 |
| 2010/0309068 | A1* | 12/2010 | Duron et al. | 343/730 |

OTHER PUBLICATIONS

Mendes et al. "Design and Analysis of a 6 GHz Chip Antenna on Glass Substrates for Integration with RF/Wireless Microsystems," IEEE 2003.

* cited by examiner

ANTENNA STRUCTURES WITH MOLDED AND COATED SUBSTRATES

BACKGROUND

This relates generally to electronic devices and, more particularly, to electronic devices with antennas.

Electronic devices such as computers and cellular telephones are often provided with antennas. Antennas may be used to handle cellular telephone communications, local wireless area network communications, and other wireless communications.

Antennas for electronic devices are sometimes formed using printed circuit boards. An antenna may, for example, include an antenna resonating element that is formed from patterned metal traces on a printed circuit substrate. Stamped metal is also sometimes used in forming antennas. For example, cavity antennas can be formed by from sheet metal structures that are supported by a plastic member.

Electronic device antennas can also be formed using other arrangements. In some configuration, antennas may be formed using patterned metal traces formed directly on molded plastic carriers. This type of antenna configuration may be implemented using laser-based processing techniques that selectively sensitize regions on the surface of a molded carrier so that metal traces may be electroplated onto those regions in a desired pattern. In other configurations, patterned antenna traces can be formed on a plastic carrier using two-shot plastic molding techniques in which each shot of plastic has a different affinity to metal deposition by electroplating.

Challenges can arise in manufacturing and operating antennas for electronic devices. In some applications, antennas formed using laser-based processing and two-shot molding techniques are able to provide desired levels of performance, but are not as inexpensive to fabricate as desired. Alternative antenna arrangements, such as arrangements based on printed circuits or stamped metal parts, may help reduce manufacturing costs, but may not perform as well as desired.

It would therefore be desirable to be able to provide improved techniques for forming electronic device antennas.

SUMMARY

Electronic devices may be provided with antenna structures. The antenna structures may be used in wirelessly transmitting and receiving radio-frequency signals.

Antenna structures may be formed from molded dielectric substrates. Molding equipment such as a hot pressing tool may be used to compress dielectric material into a desired shape. The dielectric substrates may be formed from molded materials such as glass or ceramic. Sheets of dielectric or dielectric powder may be compressed by the hot pressing equipment to mold the dielectric into a desired dielectric substrate shape.

Patterned conductive material may be formed on dielectric substrates. The patterned conductive material may be formed from metallic paint or other conductors. A hollow antenna chamber may be formed by joining molded dielectric structures. A molded dielectric structure may be attached to a printed circuit or other structure using solder or other conductive joining material.

An antenna such as an indirectly-fed loop antenna or other antenna may be formed from molded dielectric substrates and patterned conductors. The antenna may be mounted in an electronic device under a portion of a dielectric display cover layer or other dielectric structure.

Further features of the invention, its nature and various advantages will be more apparent from the accompanying drawings and the following detailed description of the preferred embodiments.

DETAILED DESCRIPTION

Electronic devices may be provided with antennas and other wireless communications circuitry. The wireless communications circuitry may be used to support wireless communications in multiple wireless communications bands. One or more antennas may be provided in an electronic device. For example, antennas may be used to form an antenna array to support communications with a communications protocol such as the IEEE 802.11(n) protocol that uses multiple antennas. Antennas may also be used to support communications in other wireless local area network bands, cellular telephone network communications bands, or other wireless communications bands.

Figure 1:
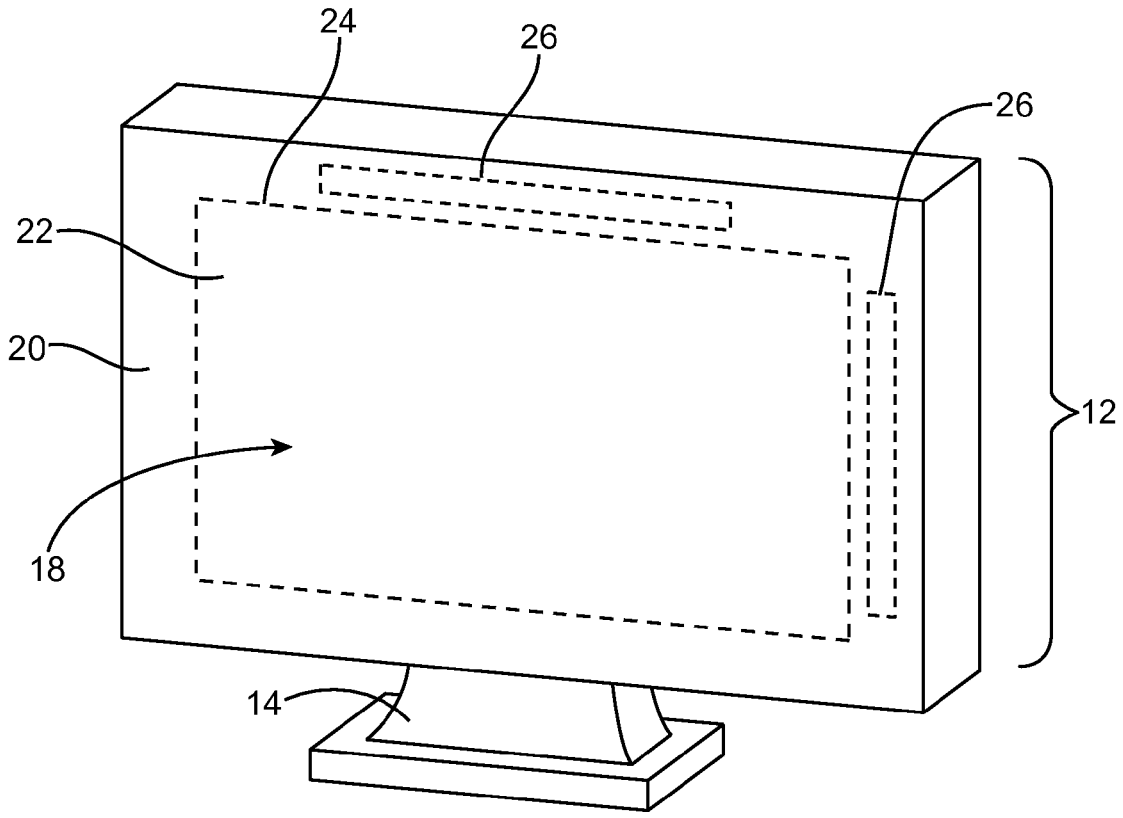
FIG. 1 is a perspective view of an illustrative electronic device with antenna structures in accordance with an embodiment of the present invention.

An illustrative electronic device of the type that may be provided with one or more antennas is shown in FIG. 1. Electronic device 10 may be a computer such as a computer that is integrated into a display such as a computer monitor. Electronic device 10 may also be a laptop computer, a tablet computer, a somewhat smaller portable device such as a wrist-watch device, pendant device, headphone device, earpiece device, or other wearable or miniature device, a cellular telephone, a media player, or other electronic equipment. Illustrative configurations in which electronic device 10 is a computer formed from a computer monitor are sometimes described herein as an example. In general, electronic device 10 may be any suitable electronic equipment.

Antennas may be formed in device 10 in any suitable location such as locations along the edge of device 10. For example, antennas may be formed in one or more locations such as locations 26 in device 10. The antennas in device 10 may include loop antennas, inverted-F antennas, strip antennas, planar inverted-F antennas, slot antennas, cavity antennas, monopoles, dipoles, patch antennas, hybrid antennas that include antenna structures of more than one type, or other suitable antennas. The antennas may cover cellular network communications bands, wireless local area network communications bands (e.g., the 2.4 and 5 GHz bands associated with protocols such as the Bluetooth® and IEEE 802.11 protocols), cellular telephone bands, and other communications bands. The antennas may support single band and/or multiband operation. For example, the antennas may be dual band antennas that cover the 2.4 and 5 GHz bands. The antennas may also cover more than two bands (e.g., by covering three or more bands or by covering four or more bands).

Conductive structures for the antennas may, if desired, be formed from conductive structures that are supported by dielectric substrates. The substrates may be formed by molding substrate material into a desired shape. If desired, some of the conductive structures in an antenna may be formed on dielectric printed circuit substrates.

The dielectric material in the antennas may be formed from glass, ceramic, or other dielectric materials. Conductive structures on the dielectric substrates may be formed from patterned metal or other conductive materials. For example, conductive antenna structures on the dielectric substrates may be formed from patterned metal traces. The conductive material may be formed by applying metallic paint to the dielectric substrates, physical vapor deposition, electrochemical deposition, other suitable techniques, or combinations of any two or more of these techniques.

Device 10 may include a display such as display 18. Display 18 may be mounted in a housing such as electronic device housing 12. Housing 12 may be supported using a stand such as stand 14 or other support structure.

Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric. In other situations, housing 12 or at least some of the structures that make up housing 12 may be formed from metal elements.

Display 18 may be a touch screen that incorporates capacitive touch electrodes or other touch sensor components or may be a display that is not touch sensitive. Display 18 may include image pixels formed from light-emitting diodes (LEDs), organic LEDs (OLEDs), plasma cells, electronic ink elements, liquid crystal display (LCD) components, or other suitable image pixel structures.

A cover glass layer may cover the surface of display 18. Rectangular active region 22 of display 18 may lie within rectangular boundary 24. Active region 22 may contain an array of image pixels that display images for a user. Active region 22 may be surrounded by an inactive peripheral region such as rectangular ring-shaped inactive region 20. The inactive portions of display 18 such as inactive region 20 are devoid of active image pixels. Display driver circuits, antennas (e.g., antennas in regions such as regions 26), and other components that do not generate images may be located under inactive region 20.

The cover glass for display 18 may cover both active region 22 and inactive region 20. The inner surface of the cover glass in inactive region 20 may be coated with a layer of an opaque masking material such as opaque plastic (e.g., a dark polyester film) or black ink. The opaque masking layer may help hide internal components in device 10 such as antennas, driver circuits, housing structures, mounting structures, and other structures from view.

The cover layer for display 18, which is sometimes referred to as a cover glass, may be formed from a dielectric such as glass or plastic. Antennas may be mounted in regions such as regions 26 under an inactive portion of the cover glass. The antennas may transmit and receive signals through the cover glass. This allows the antennas to operate, even when some or all of the structures in housing 12 are formed from conductive materials. For example, mounting the antenna structures of device 10 under part of inactive region 20 may allow the antennas to operate even in arrangements in which some or all of the walls of housing 12 are formed from a metal such as aluminum or stainless steel (as examples). In configurations for device 10 in which device 10 has dielectric antenna window structures in housing 12 or in which housing 12 is formed from dielectric, antennas may be mounted under the dielectric antenna window structures and or the housing formed from dielectric. The configuration of FIG. 1 is merely illustrative.

Antenna structures for electronic devices such as device 10 of FIG. 1 may be formed using patterned conductor. For example, an antenna may contain an inverted-F antenna resonating element formed from patterned metal traces on a dielectric substrate. The antenna may have ground structures formed from metal traces on a dielectric substrate and/or from other conductive structures such as metal housing structures. With other suitable configurations, antennas in device 10 may be based on conductive structures that form strip antennas, planar inverted-F antennas, slot antennas, cavity antennas, patch antennas, monopoles, dipoles, directly fed and indirectly fed loop antennas, hybrid antennas that include antenna structures of more than one type, or other suitable antennas.

In some situations, it may be desirable for the dielectric substrate of an antenna to be formed from printed circuit material. For example, it may be desirable for conductive antenna structures in device 10 to be supported using rigid printed circuit board substrates (e.g., rigid layers of printed circuit board material such as fiberglass-filled epoxy) or flexible printed circuit substrates (e.g., flexible layers of polyimide or other flexible sheets of polymer). Antenna substrates may also be formed using molded plastic or other dielectrics.

With one suitable arrangement, some or all of the dielectric substrate materials for the antennas in device 10 may be formed from dielectric such as glass and/or ceramic. Glass and ceramic materials may allow antennas of high quality and relatively low cost to be mass produced. Examples of glass substrate materials include glasses such as soda lime glass, borosilicate glass, and fused quartz. An example of a ceramic substrate material is boron nitride ceramic. These are merely illustrative examples. In general, any suitable glass and/or ceramic materials may be used in forming antenna structure substrates. Such substrate materials may, if desired, be used in hybrid arrangements in which antenna structures are formed from both glass or ceramic material and one or more additional material such as plastic, printed circuits, etc. Antenna substrate configurations based on glass and ceramic are sometimes described herein as an example.

Glass and ceramic materials may be formed into desired shapes for antenna substrates using cutting tools, molding tools (e.g., dies that apply heat and pressure), grinding tools, and other suitable equipment. Glass and ceramic antenna substrates may be formed from glass powder and ceramic powder or may be formed from solid pieces of glass and ceramic (e.g., glass or ceramic sheets).

Figure 2:
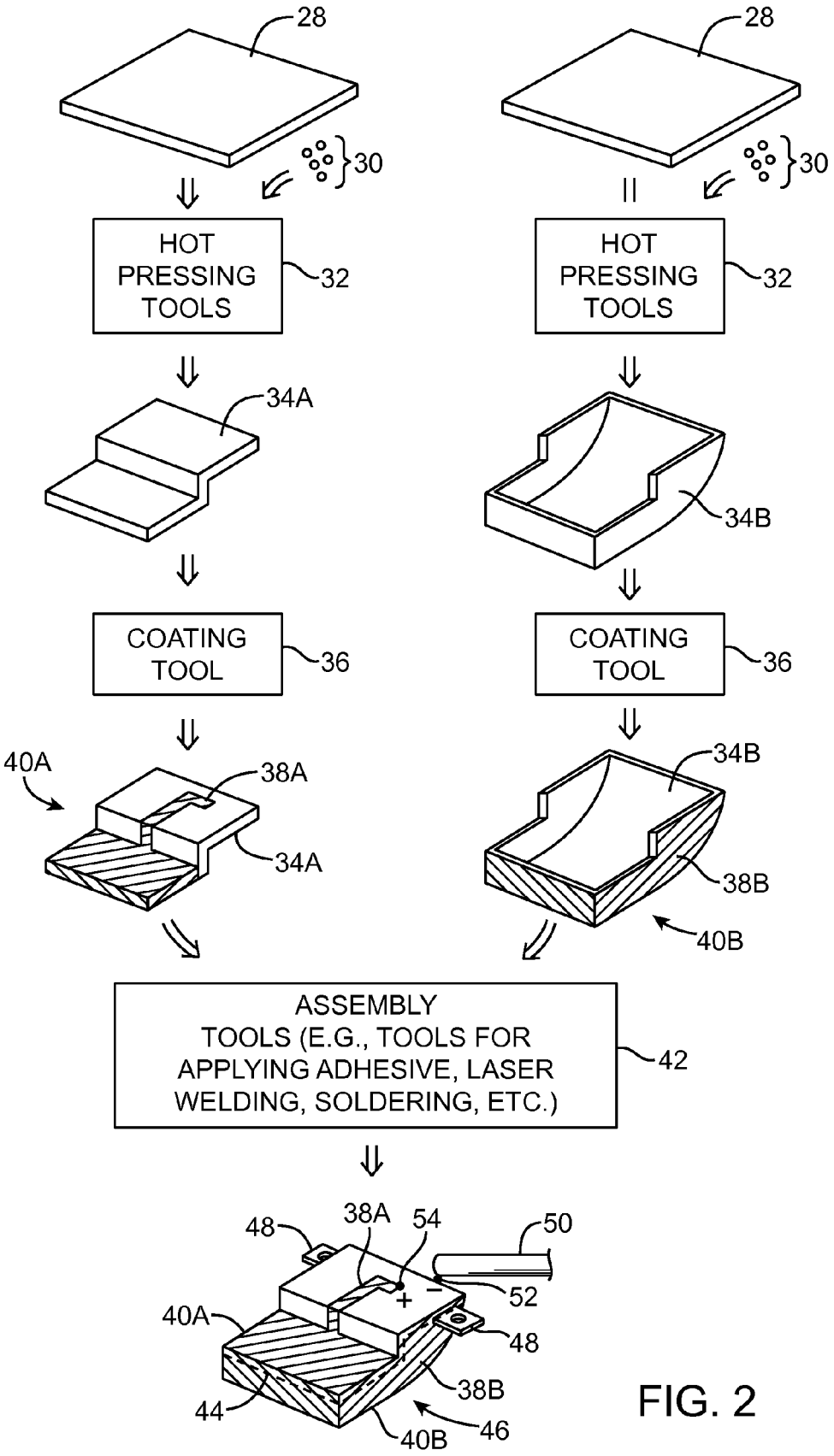
FIG. 2 is a diagram showing how molding and coating techniques may be used to form electronic device antennas in accordance with an embodiment of the present invention.

FIG. 2 is a diagram showing how antenna structures for device 10 may be formed from dielectric substrate materials such as glass or ceramic. As shown in FIG. 2, raw dielectric material may be provided in the form of dielectric sheets 28 and/or dielectric powder 30. Sheets 28 and powder 30 may be formed from glass (e.g., soda lime glass, borosilicate glass, fused silica, etc.) or may be formed from ceramic (e.g., boron nitride ceramic).

Dielectric material such as sheets 28 and powder 30 may be formed into one or more dielectric antenna substrate structures. In the example of FIG. 2, two separate dielectric antenna structures 34A and 34B are formed using equipment 32. Structures 34A and 34B are subsequently joined together to form a completed antenna. If desired, other numbers of substrate structures may be formed (e.g., a single substrate structure, two or more substrate structures, three or more substrate structures, four or more substrate structures, etc.) and these structures subsequently assembled to form a desired antenna. The example of FIG. 2 in which an antenna substrate is formed from two dielectric antenna structures is merely illustrative.

Tools 32 may include hot pressing equipment (e.g., heated dies or other equipment for applying heat and pressure). The hot pressing equipment may be used to compress sheets 28 or powder 30 into desired shapes. Hot pressing tools 32 may, for example, form dielectric structures with angled bends, shapes with curves, shapes with compound curves, shapes with openings (e.g., circular or rectangular holes or holes having a combination of straight and curved edges), shapes that form open pockets (e.g., open-topped boxes), shapes that form planar covering structures (e.g., shapes with portions that are configured to cover openings), etc.

In the example of FIG. 2, molded dielectric structures 34A has the shape of a cover with two right-angle bends and molded dielectric structures 34B forms a recessed cavity with an opening shape that can be covered by the cover shape of dielectric structures 34A. If desired, a cover for a molded dielectric structure may be formed from a cut sheet of planar glass or ceramic material (i.e., a dielectric antenna substrate may be formed from one or more molded dielectric structures and one or more sheets of material or other dielectric shapes that have not been molded). Illustrative arrangements in which multiple molded parts are used in forming dielectric antenna substrate structures are sometimes described herein as an example.

Following the heating and compressing of dielectric structures 28 or 30 to form molded dielectric structures 34A and 34B, structures 34A and/or 34B may be coated with conductive material. Coating tools 36 may, for example, be used to form patterned metal traces or other conductive material on the surfaces of structures 34A and 34B.

Coating tools 36 may include tools for applying metallic paint (sometimes referred to as metallic paste or ink) or other conductive liquids to the surfaces of dielectric structures. Examples of equipment that may be used in applying conductive liquids such as metallic paint include painting equipment, screen printing equipment, ink jet printing equipment, dipping equipment, spraying equipment, and pad printing equipment. Following application of metallic paint, heat may be applied to sinter the paint (e.g., using an oven, heat gun, or other heat application equipment in coating tools 36 to sinter the metallic paint at a temperature of 200° C. to 300° C., a temperature above 200° C., or other suitable sintering temperature).

Coating tools 36 may also include equipment for depositing metal using physical vapor deposition (e.g., sputtering or evaporation), electrochemical deposition, or other techniques for applying metals and other conductive materials to the surfaces of dielectric structures. Coating tools 36 may include photolithographic equipment for patterning coatings (e.g., by wet or dry etching), laser processing equipment (e.g., laser processing equipment for etching deposited coatings), or other patterning equipment. Patterns may also be incorporated into conductive coatings during the application of metallic paint or other metal deposition processes.

As shown in FIG. 2, following the application of patterned conductive coatings (e.g., sintered metallic paint or other materials), antenna structures 40A may include patterned conductive coating 38A and antenna structures 40B may include patterned conductive coating 38B.

Assembly tools 42 may be used to combine antenna structures such as antenna structures 40A and 40B to form antenna structures 46. Assembly tools 42 may include tools for applying adhesive that is used in joining structures together, tools for laser welding structures together, tools for soldering structures together, tools for press fitting one structure into another, tools for applying heat, or other suitable equipment.

Using tools 42, structures such as structures 40A and 40B of FIG. 2 may be connected together to form antenna structures 46. As shown in FIG. 2, for example, structures 40A and 40B may be attached to each other along seam 44. Adhesive, welds (e.g., laser welds), solder joints, or other types of bonds may be used in connecting the conductive and/or dielectric materials that lie along seam 44.

Tools 42 may also be used to attach additional items to antenna structures 46 such as transmission line 50 and support structure 48.

Transmission line 50 may be, for example, a coaxial cable having an outer ground conductor that is coupled to ground antenna feed terminal 52 and an inner positive conductor that is coupled to positive antenna feed terminal 54. Positive antenna feed terminal 54 and ground antenna feed terminal 52 may be used in forming an antenna feed for the antenna that is formed from antenna structures 46. The positive and ground feed terminals may be coupled to conductive structures such as patterned conductive layer 38A and patterned conductive layer 38B using solder or other suitable attachment mechanisms.

If desired, some of the conductive structures may be used in forming an antenna resonating element structure (e.g., an inverted-F antenna resonating element or loop antenna resonating element) and other conductive structures may be used in forming antenna ground structures (e.g., a ground plane, a cavity with ground structures, etc.). In general, conductive structures on the surfaces of the dielectric substrates may be used in forming conductive cavities for cavity-backed antennas, antenna resonating elements, parasitic antenna elements, slots for slot antennas, loop antenna structures, feed terminal structures, and other conductive antenna structures.

Support structures such as support structure 48 of FIG. 2 may be formed from plastic or other dielectric materials or may be formed from conductive materials such as metal. Support structure 48 may be, for example, a metal bracket having screw holes. During assembly, screws may pass through the screw holes in the bracket and may be used in mounting antenna structures 46 within housing 12 of device 10 (e.g., in regions 26 of FIG. 1).

Figure 3:
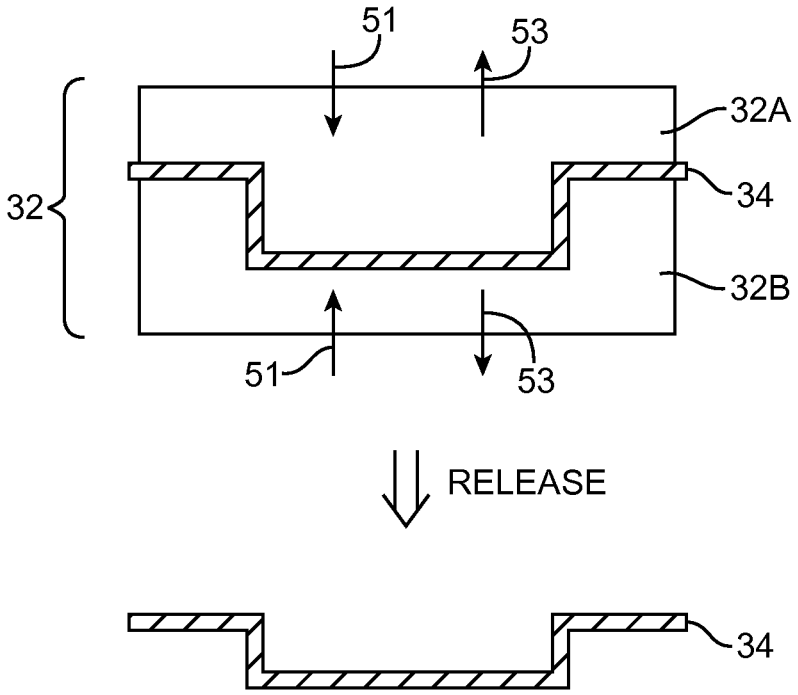
FIG. 3 is a cross-sectional side view of a system of the type in which hot press equipment or other heated molding equipment may be used to form an antenna substrate in accordance with an embodiment of the present invention.

FIG. 3 shows how hot pressing tools 32 may be used in forming dielectric structures such as dielectric structure 34. Hot pressing equipment 32 of FIG. 3 may include first press structure 32A and second press structure 32B (i.e., heated metal die structures). Dielectric material such as a sheet of glass or ceramic (sheet 28 of FIG. 2) and/or powdered material such as glass or ceramic material (powder 30 of FIG. 2) may be compressed between press structures 32A and 32B as structures 32A and 32B are moved towards each other in directions 51. Structures 32A and 32B may be heated to a temperature sufficient to soften the dielectric sheet or powder material (e.g., 700° C. or 800° C. or more), thereby facilitating formation of a desired shape for dielectric structure 34. Once structure 34 has been compressed into its desired shape, the mold formed by hot press die structures 32A and 32B may be released by moving structures 32A and 32B apart in directions 53. The resulting shape for structure 34, which is illustrated in the lower portion of FIG. 3, may match the shape of the interior surfaces of hot press structures 32A and 32B.

Figure 4:
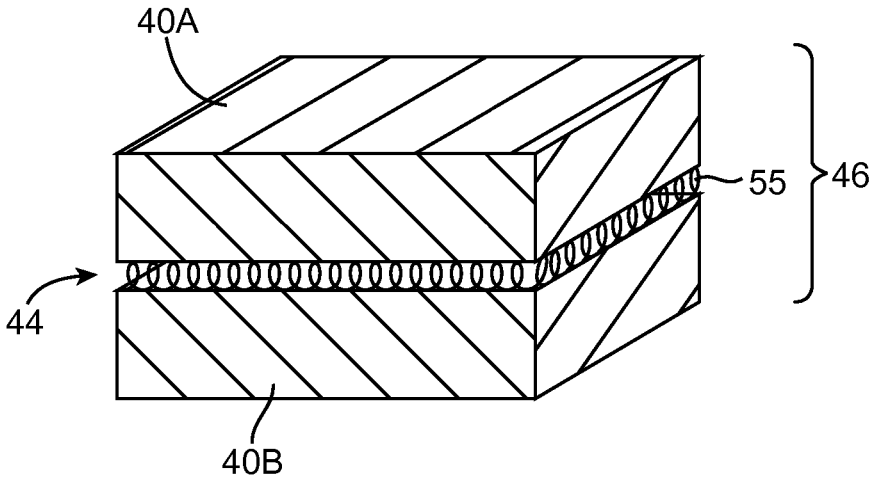
FIG. 4 is a perspective view of illustrative antenna structures formed from two glass or ceramic substrate portions that have been coated with metal paint and joined together in accordance with an embodiment of the present invention.

FIG. 4 shows how structures such as structures 40A and 40B may be joined to form antenna structures 46 using joining material 55. Joining material 55 may be solder, conductive adhesive, molten portions of structures 40A and 40B (e.g., molten metal and/or molten dielectric) or other joining material. Material 55 may be used in attaching structures 40A and 40B and the conductive coatings on structures 40A and 40B to each other. Tools 42 may include heating tools (e.g., a solder reflow oven for melting solder paste to form solder 55), welding tools (e.g., laser welding equipment or other welding equipment for melting metal and/or dielectric structures in structures 40A and 40B), press-fitting tools for pressing structures 40A and 40B together, and other equipment for joining structures such as structures 40A and 40B to form antenna structures 46.

Figure 5:
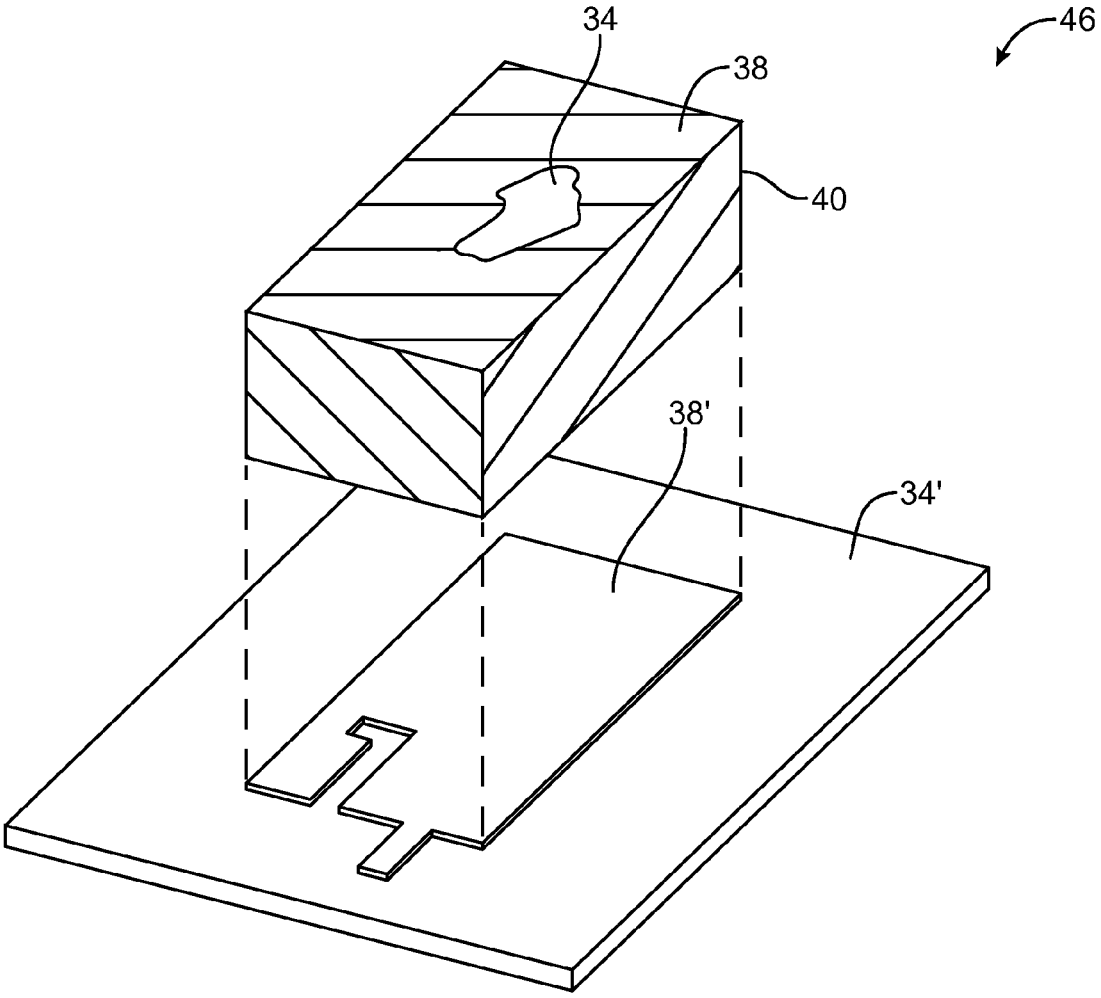
FIG. 5 is an exploded perspective view of an electronic device antenna formed from a molded substrate coated with conductor and an associated printed circuit in accordance with an embodiment of the present invention.

As shown in the exploded perspective view of FIG. 5, antenna structures 46 may be formed by attaching a structure such as structure 40 that has a glass or ceramic substrate to a printed circuit board or other dielectric member such as printed circuit board 34'. Structures 40 may include a molded glass or ceramic substrate such as substrate 34. A dielectric sheet or powdered dielectric may be pressed into a desired shape using hot pressing tools 32 to form substrate 34. Conductive coating 38 may be formed on the surface of dielectric substrate 34 using coating equipment 36. Printed circuit board 34' may be a rigid printed circuit board (e.g., a printed circuit board having a dielectric substrate formed from a rigid material such as fiberglass-filled epoxy), a flexible printed circuit ("flex circuit") formed from a flexible polymer sheet such as a layer of polyimide, or other suitable printed circuit substrate. Patterned conductor 38' may be formed from metal. For example, patterned conductor 38' may be formed from metal deposited on printed circuit substrate 34' by physical vapor deposition techniques and patterned using photolithographic processing (as an example).

Solder, conductive adhesive, or other joining material 55 (FIG. 4) may be used in joining conductive material 38 of structures 40 to conductive material 38' on printed circuit board substrate 34'. Structures 40 may, if desired, have a recessed cavity shape. For example, structures 40 may form a rectangular box or a chamber of other suitable shapes with a downward-facing opening (in the FIG. 5 example). Exterior surfaces of the chamber (e.g., all of the upper surfaces and side surfaces of substrate 34 in the orientation shown in FIG. 5) may be coated with conductive layer 38, whereas the lowermost portion of the chamber (i.e., the opening in substrate 34 facing opposing conductive layer 38') may be free of conductive material. Metal 38' may, if desired, be configured to form an antenna resonating element for antenna structures 46 and structures 40 may be used in forming a conductive antenna cavity for antenna structures 46 (i.e., antenna structures 46 may form a cavity-backed antenna). Other types of antenna structures may be formed by joining a glass or ceramic substrate with a patterned conductive coating to a printed circuit board. The example of FIG. 5 is merely illustrative.

Figure 6:
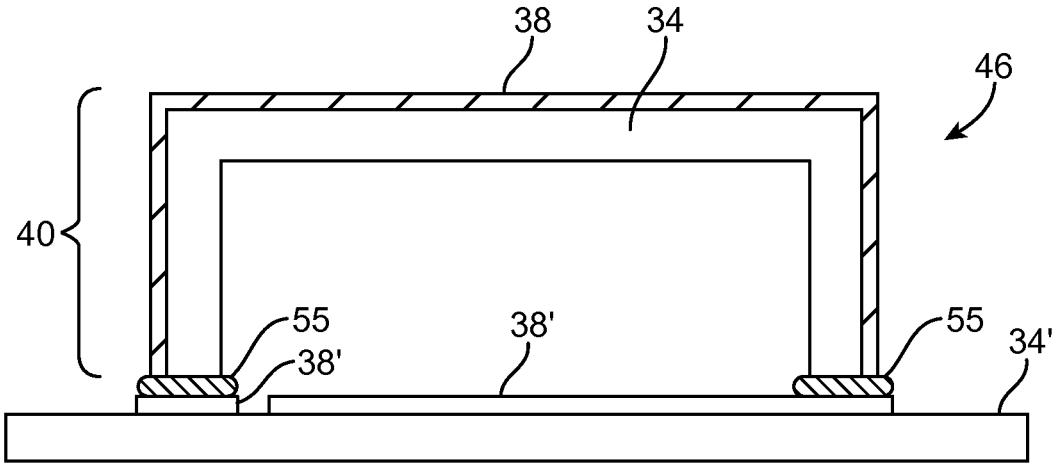
FIG. 6 is a cross-sectional side view of illustrative antenna structures formed from a molded substrate that has been soldered to a printed circuit in accordance with an embodiment of the present invention.

FIG. 6 is a cross-sectional side view of illustrative antenna structures 46 that have been formed by attaching structures 40 to printed circuit board substrate 34'. Structures 40 may include dielectric substrate 34. Substrate 34 may be formed by using hot pressing tools 32 to press a glass or ceramic sheet or a glass or ceramic powder into a desired shape. Structures 40 may be formed by using coating tool 36 to form patterned conductive layer 38 on molded dielectric substrate 34. Solder 55 or other joining material may be used to connect conductive layer 38 and structures 40 to printed circuit board conductors 38' on printed circuit board substrate 34'. If desired, other dielectric substrates (e.g., planar sheets of plastic, etc.) may be provided with patterned conductive material and attached to structures 40 to form antenna structures 46. The example of FIG. 6 is merely illustrative.

Antenna structures 46 may, if desired, include a loop antenna resonating element. The loop antenna resonating element may be directly fed by coupling a coaxial cable or other transmission line to antenna feed terminals on the loop antenna resonating element. The loop antenna resonating element may also be indirectly fed.

Figure 7:
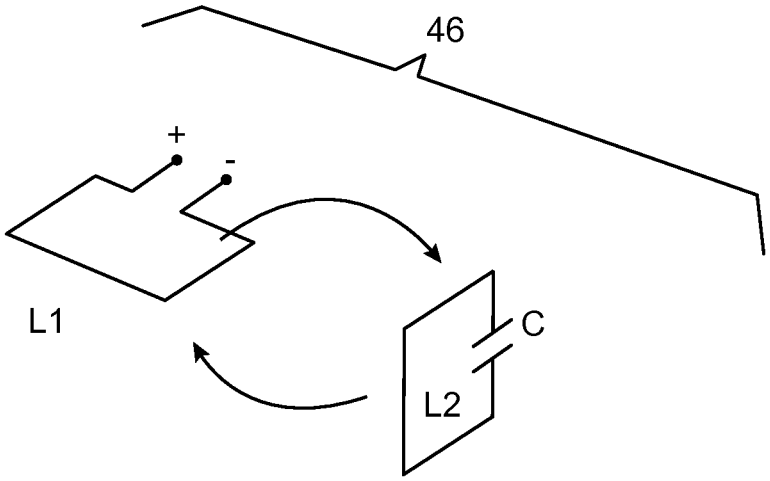
FIG. 7 is a schematic diagram of an illustrative indirectly fed loop antenna that may be formed using glass or ceramic substrate materials in accordance with an embodiment of the preset invention.

An illustrative configuration for an indirectly fed loop antenna of the type that may be used in device 10 is shown in FIG. 7. Antenna structures 46 of FIG. 7 may be formed from first structures 40A and second structures 40B, which are coupled along seam 44 (e.g., by solder, welding, conductive adhesive, etc.), as described in connection with FIG. 4. Structures 40B are shown in the perspective view of FIG. 9. The placement of structures 40B on the lower portion of structures 40A within antenna structures 46 is illustrated by the position of dashed lines 40B in FIG. 8.

As shown in FIG. 7, antenna structures 46 may have two loop-based portions (L1 and L2). In particular, antenna structures 46 may have a first portion formed from antenna resonating element structure L2 and a second portion formed from antenna feed structure L1. Structure L2 forms an antenna loop with an interposed capacitor C. In structure L2, current may loop within conductive material 38 about axis 60, as indicated by current IL2. In structure L1, which serves as a feed structure for the antenna formed by structures 46, current may loop as shown by current IL1. Electromagnetic near-field coupling may be used in coupling signals between feed structure L1 and antenna resonating element loop structure L2.

Feed structure L1 may be a loop antenna structure that is directly fed by a transmission line such as a coaxial cable at a positive antenna feed terminal and ground antenna feed terminal. Antenna resonating element structure L2 may be a loop antenna structure having conductive material 38 that loops around and extends along longitudinal axis 60 of structure L2. Antenna feed structure L1 and structure L2 may be formed by patterned conductive material (e.g., a patterned metal coating layer formed from conductive paint or other conductive material) on dielectric substrate 34 (e.g., a molded glass or ceramic structure).

Figure 8:
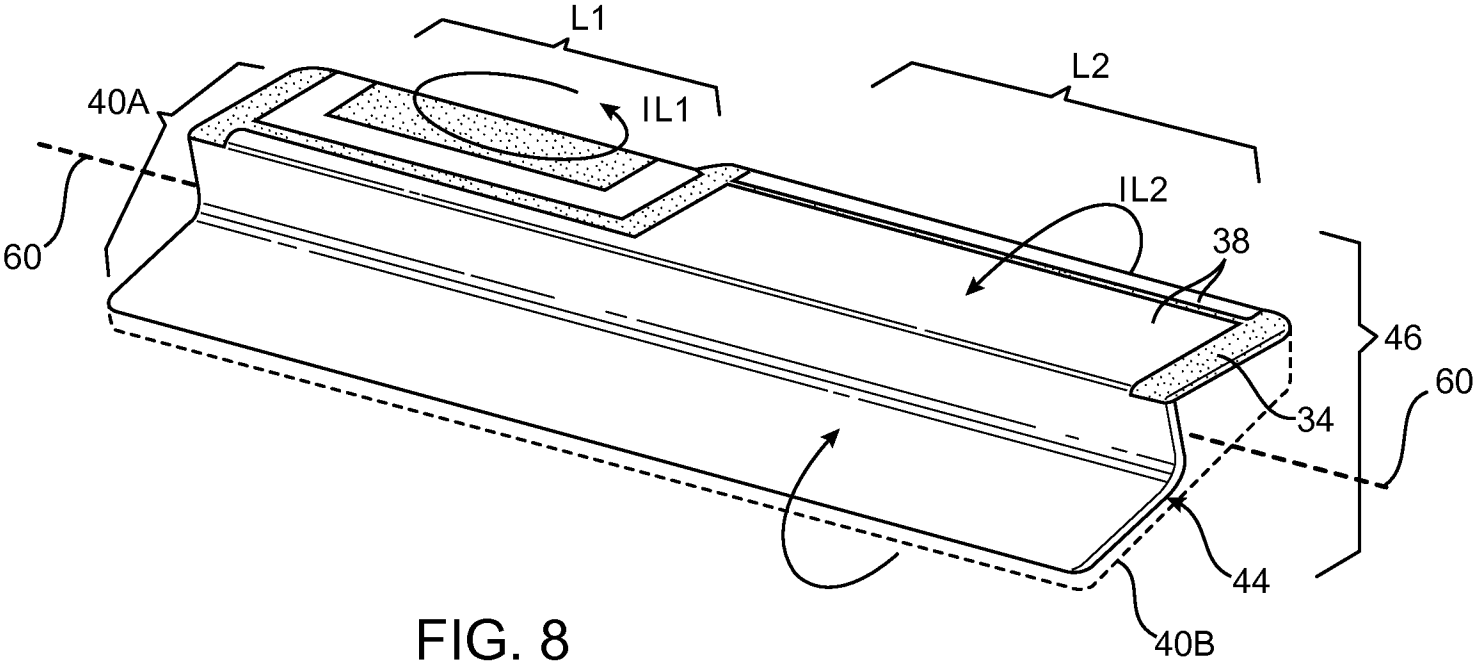
FIG. 8 is a perspective view of a top half of an illustrative two-part antenna structure showing where a bottom half of the two-part antenna structure may be attached to the top half in accordance with an embodiment of the present invention.
Figure 9:
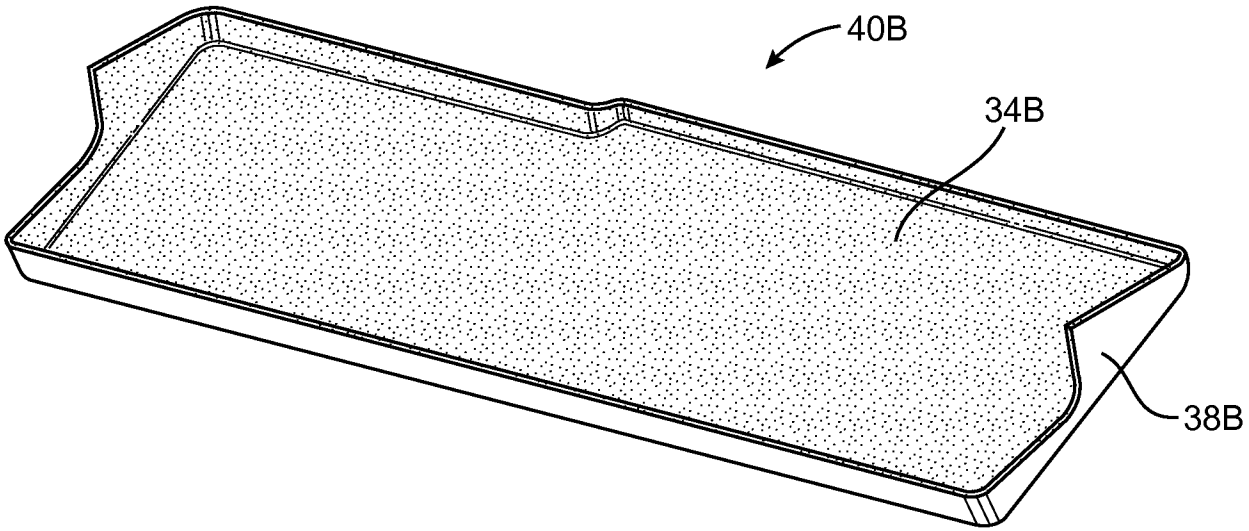
FIG. 9 is a perspective view of the bottom half of the illustrative two-part antenna structure that is configured to mate with the top half structure of FIG. 8 in accordance with an embodiment of the present invention.
Figure 10:
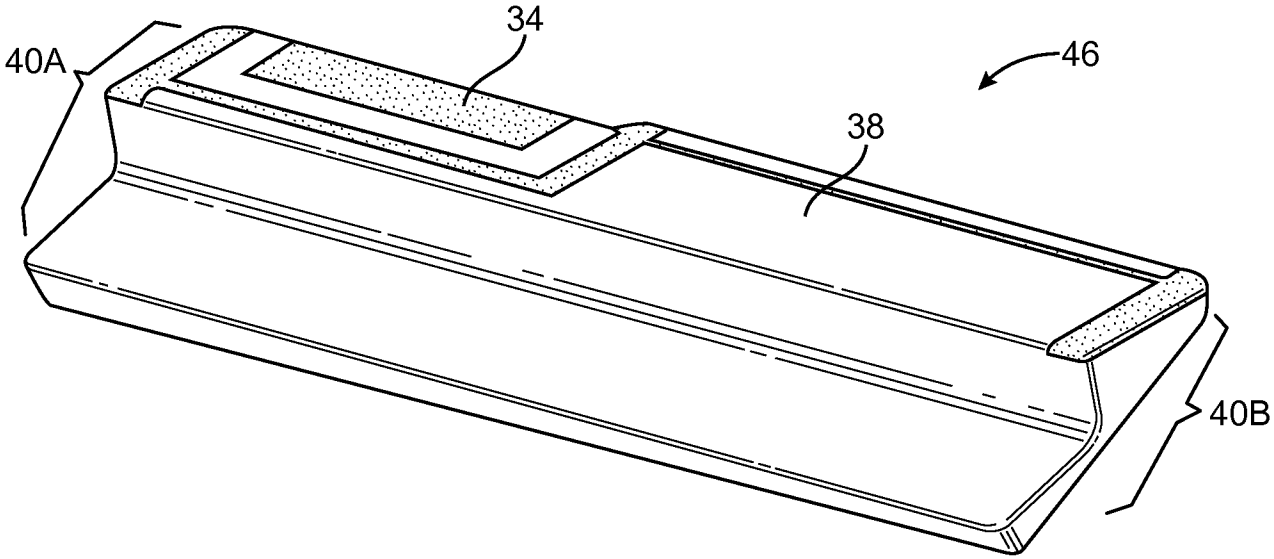
FIG. 10 is a perspective view of antenna structures formed from coupling the top half structure of FIG. 8 with the bottom half structure of FIG. 9 in accordance with an embodiment of the present invention.

FIG. 10 is a perspective view of antenna structures 46 that have been formed by joining structures 40A of FIG. 8 with structures 40B of FIG. 9.

Figure 11:
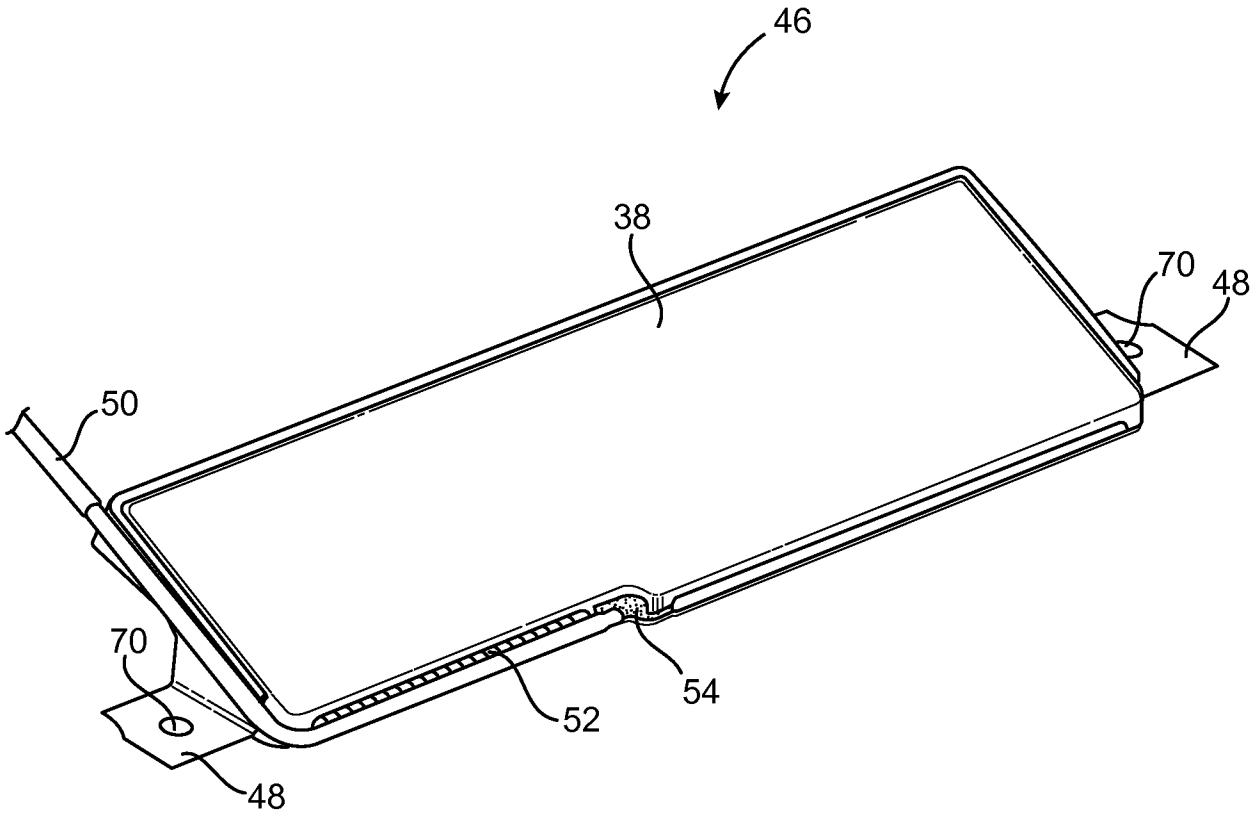
FIG. 11 is a perspective view of the antenna structures of FIG. 10 following attachment of a metal bracket and a coaxial cable in accordance with an embodiment of the present invention.

FIG. 11 is a perspective view of antenna structures 46 of FIG. 10 viewed from the opposing side. As shown in FIG. 11, coaxial cable 50 may have a positive conductor coupled to conductive layer 38 at antenna feed terminal 54 and an exposed length of outer ground conductor that is soldered to layer 38 to form ground antenna feed terminal 52. Support structure 48 (e.g., a metal bracket) has been attached (e.g., by press fitting) around antenna structures 46. Screw holes 70 may be used to mount antenna structures 46 of FIG. 11 to housing 12 of device 10.

Figure 12:
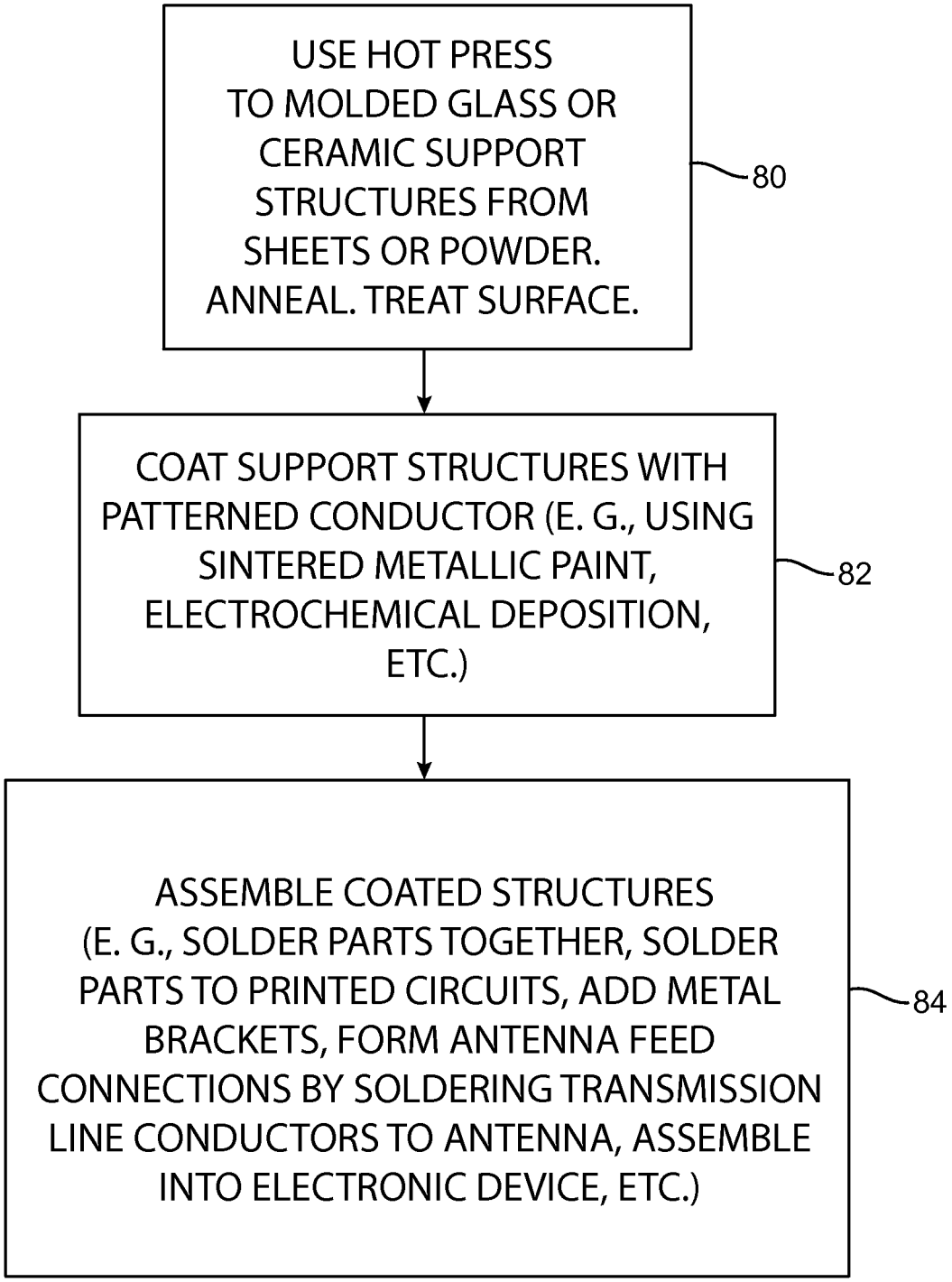
FIG. 12 is a flow chart of illustrative steps involved in forming antenna structures in accordance with the present invention.

Illustrative steps involved in forming antenna structures 46 are shown in FIG. 12. At step 80, dielectric molding equipment such as hot pressing tools 32 may be used in compressing dielectric sheets 28 and/or dielectric powder 30 to form dielectric structures 34 (e.g., structures 34A and 34B of FIG. 2). Dielectric sheets 28 and powder 30 may be, for example, glass, ceramic, a glass reinforced with hydrocarbon binders (e.g., epoxy) and ceramic (e.g., ceramic powder to lower the dielectric constant of the dielectric material), polymers (e.g. to form printed circuit substrates and plastic carriers), other dielectric substrates, or combinations of any two or more of these substrate materials. Glass or ceramic sheets may have a thickness of 0.1 to 1 mm thick, a thickness of 0.3 to 0.7 mm thick, a thickness of 0.4 to 0.6 mm thick, a thickness of less than 0.6 mm, a thickness of more than 0.3 mm, or other suitable thickness. The structures formed from powder 30 may have a thickness of 0.1 to 1 mm (as an example). An organic binding agent may, if desired, be incorporated into powder 30.

During the molding operations of step 80, hot press equipment 32 may elevate the temperature of sheets 28 and/or powder 30 to a level that is sufficient to soften sheets 28 and/or powder 30 and thereby facilitate molding. Annealing operations may be performed after pressing (e.g., in an annealing mold formed from a ceramic holder structure that maintains the desired shape for the molded part). A powder may be used in the annealing mold to serve as a de-molding agent. Following annealing, post-annealing processes may be performed (e.g., to trim, polish, and otherwise shape dielectric structures 34). To facilitate subsequent conductive coating operations, the surface of structures 34 may be cleaned and roughened. Surface treatments such as wet etching (chemical cleaning) and dry etching (e.g., plasma etching) may be used in preparing the surfaces of dielectric structures 34 for coating.

During the operations of step 82, the surface of structures 34 may be coated with a patterned conductive material for forming antenna structures 46. A conductive layer may, for example, be formed by printing a metallic substance such as silver (metallic) paint (also sometimes referred to as silver paste or silver ink) onto the surface of structures 34 or applying metallic paint such as silver paint using a paint brush. Following deposition of the patterned silver paint layer, a metallic coating may be formed by sintering the silver paint in an oven at an elevated temperature (e.g., a temperature above 200° C.) or otherwise applying heat to the silver paint. Optional metallic plating may be deposited (e.g., grown) on the metallic paint structures using electrochemical deposition (electroplating) techniques. The optional plated metal coating layer may help enhance the strength of the metallic paint. If desired, other techniques may be used for forming patterned conductive layer 38 (e.g., physical vapor deposition followed by lithographic patterning, other types of metallic paint deposition, etc.).

At step 84, after forming dielectric structures with metallic coatings such as structures 40A and 40B of FIG. 2 (i.e., dielectric antenna carrier structures coated with patterned conductor), the structures may be assembled together using appropriate fixtures in assembly tools 42. When assembled, the dielectric structures (in the example of FIG. 11) form dielectric walls that surround an air-filled chamber (cavity).

Metal brackets such as bracket 48 of FIG. 11 may be added (e.g., by press fitting) and coaxial cables such as cable 50 or other transmission lines may be connected to antenna feed terminals on conductive coating 38. Bracket 48 may be, for example, a sheet metal part that is cut and bent using metal stamping and bending tools. The thickness of the sheet metal that is used in forming bracket 48 may be, for example, 0.1 to 0.5 mm or 0.2 to 0.3 mm (as examples). Bracket (brace) 48 may be soldered to structures 40A and 40B by applying solder between bracket 48 and structures 40A and 40B. Solder or other joining material may also be used to form a joint along seam 44 (i.e., seam 44 may be soldered, welded, etc.). Cable 50 may be soldered along the edge of structures 46 and the positive conductor in the center of cable 50 may be soldered to a positive antenna feed terminal location on conductive coating 30 on antenna structures 46.

If desired, a protective surface coating such as a clear organic material with a low dielectric constant may be applied to the surface of antenna structures 46 in areas other than grounding locations on antenna structures 46. Antenna structures 46 may then be mounted within housing 12 and electronic device 10.

The foregoing is merely illustrative of the principles of this invention and various modifications can be made by those skilled in the art without departing from the scope and spirit of the invention.

What is claimed is:

1. A method, comprising:

molding a first dielectric structure in heated molding equipment;

molding a second dielectric structure in heated molding equipment, wherein the first and second dielectric structures comprise dielectric material selected from the group consisting of glass and ceramic;

applying a patterned conductive layer to the molded first and second dielectric structures to form a first loop antenna structure and a second loop antenna structure, wherein the first and second loop antenna structures form an indirectly-fed loop antenna, wherein applying the patterned conductive layer to the molded first and second dielectric structures to form the first loop antenna structure and the second loop antenna structure comprises:

applying the patterned conductive layer to the molded first and second dielectric structures to form a loop antenna and a loop-shaped feeding conductor that is configured to indirectly feed the loop antenna;

attaching the molded first dielectric structure to the molded second dielectric structure using conductive material to form a carrier for the indirectly-fed loop antenna.

2. The method defined in claim 1, wherein the loop antenna is formed along at least three sides of the carrier.

3. The method defined in claim 2, wherein the loop-shaped feeding conductor is formed along at least two sides of the carrier.

* * * * *